US005649510A

United States Patent [19]

Linze

[11] Patent Number: 5,649,510

[45] Date of Patent: Jul. 22, 1997

[54] HEAT SHIELD APPARATUS FOR THE SOLENOID OF A STARTER

[75] Inventor: George Linze, Del City, Okla.

[73] Assignee: Unit Parts Company, Oklahoma City, Okla.

[21] Appl. No.: 606,161

[22] Filed: Feb. 23, 1996

[51] Int. Cl.[6] ..... F02B 77/00

[52] U.S. Cl. ..... 123/198 E; 310/52; 310/64; 310/89

[58] Field of Search ..... 310/89, 64, 52; 123/198 E; 290/48; 335/278

[56] References Cited

U.S. PATENT DOCUMENTS 5,233,953 8/1993 Whithurst et al. ..... 123/198 E

*Primary Examiner*—Thomas M. Dougherty
*Assistant Examiner*—Burton S. Mullins
*Attorney, Agent, or Firm*—Dunlap & Codding, P.C.

[57] ABSTRACT

The present invention is a heat shield apparatus for shielding a solenoid of a starter from heat generated by an engine. The apparatus is provided with a heat shield positionable between the engine and the solenoid. A clipping assembly is connected to the heat shield for clippingly and detachably connecting the heat shield to the solenoid of the starter such that the heat shield is maintained a predetermined distance from the solenoid and in a predetermined position whereby the heat shield shields the solenoid from heat.

19 Claims, 3 Drawing Sheets

HEAT SHIELD APPARATUS FOR THE SOLENOID OF A STARTER

BACKGROUND OF THE INVENTION

1. Field of the Invention

The present invention relates generally to heat shields, and more particularly, but not by way of limitation, to a heat shield apparatus for the solenoid of a starter wherein the heat shield apparatus is clippingly connected to the solenoid.

2. Description of Related Art

Starters for automobiles are well known in the art. In general, a starter is provided with a solenoid for moving a drive gear into a flywheel engaging position when the automobile is started. The solenoid of the starter defines a coil receiving space adapted to receive an internal solenoid coil having a plurality of windings of wire wrapped thereabout. Because the starter and the solenoid are disposed near the engine and are subjected to a great deal of heat, it is necessary to shield the solenoid from such heat. Otherwise, the insulation on the wire of the internal solenoid coil will melt and short out such coil or, the overheated solenoid may draw an excess of current from the automobile's battery thereby leading to premature battery failure. To protect the solenoid of the starter from heat, automobiles presently are provided with a solenoid heat shield as original equipment.

These prior art solenoid heat shields are typically provided with a single body member positioned between the solenoid and the engine. Depending upon the engine and the model of automobile, these prior art solenoid heat shields vary widely in configuration and mounting equipment. Typically, the body member is connected to the starter by arms with holes formed therethrough for accommodating a bolt whereby the arms are bolted to the starter, for example.

While the prior art solenoid heat shields function to protect the solenoid from heat, problems have been encountered in the removal and/or the replacement of the solenoid heat shields and starters. For example, when replacement of a starter is required, a problem has been that the original solenoid heat shield will not mount to the replacement starter because the replacement starter may not have the same dimensions as the original starter. In other words, if the replacement starter is slightly larger or smaller than the original starter then the original heat shield cannot be utilized. Thus, one has to either buy a new solenoid heat shield to replace the original solenoid heat shield or operate the replacement starter without a heat shield thereby leading to premature starter failure.

Due to the great number of different configurations of the prior art solenoid heat shields presently available it is impractical for solenoid heat shields to be sold on the aftermarket. Therefore, a replacement prior art solenoid heat shield must be obtained from the original automobile manufacturer, such as General Motors, and normally costs a consumer more than the replacement starter.

To this end, a need has long existed for a heat shield for the solenoid of a starter that can be installed on various makes and models of automobiles and that can replace the original solenoid heat shield provided by the automobile manufacture without requiring the same specialized mounting equipment as the original solenoid heat shield. It is to such an apparatus that the present invention is directed.

DETAILED DESCRIPTION

Figure 1:
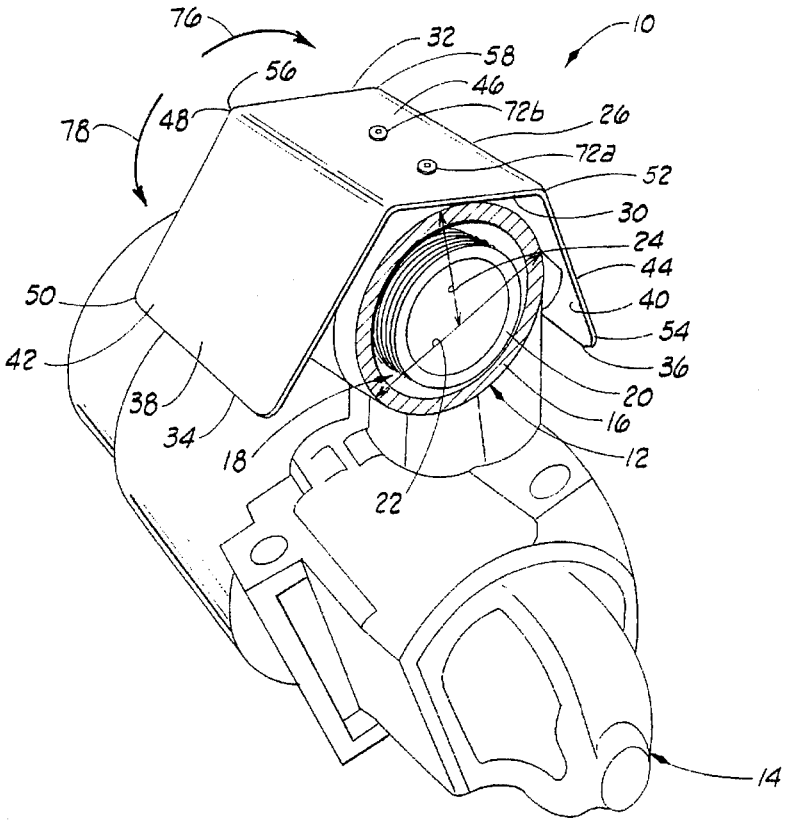
FIG. 1 is a partial cut-away, perspective view of a heat shield apparatus constructed in accordance with the present invention connected to a solenoid of a starter.

Referring now to the drawings and in particular to FIG. 1, a universal heat shield apparatus 10 (FIGS. 1, 2 and 5) constructed in accordance with the present invention is shown connected to a solenoid 12 (FIGS. 1, 3, 4 and 5) of a starter 14 (FIG. 1) mounted near an engine (not shown). The starter 14 is a conventional starter for an automobile of the variety typically manufactured by General Motors. It should be understood that the starter 14 can be any starter so long as the starter 14 has a solenoid connected thereto.

The solenoid 12 of the starter 14 has a continuous sidewall 16 (FIGS. 1 and 5) defining a coil receiving space 18 (FIG. 1) adapted to receive an internal solenoid coil 20 (FIG. 1). The solenoid 12 has a diameter 22 (FIG. 1) and a radius 24 (FIG. 1). The use and the construction of starters, such as the starter 14, are well known in the art. Thus, no further explanation is deemed necessary to teach one skilled in the art to use or construct the starter 14 or the solenoid 12.

Figure 2:
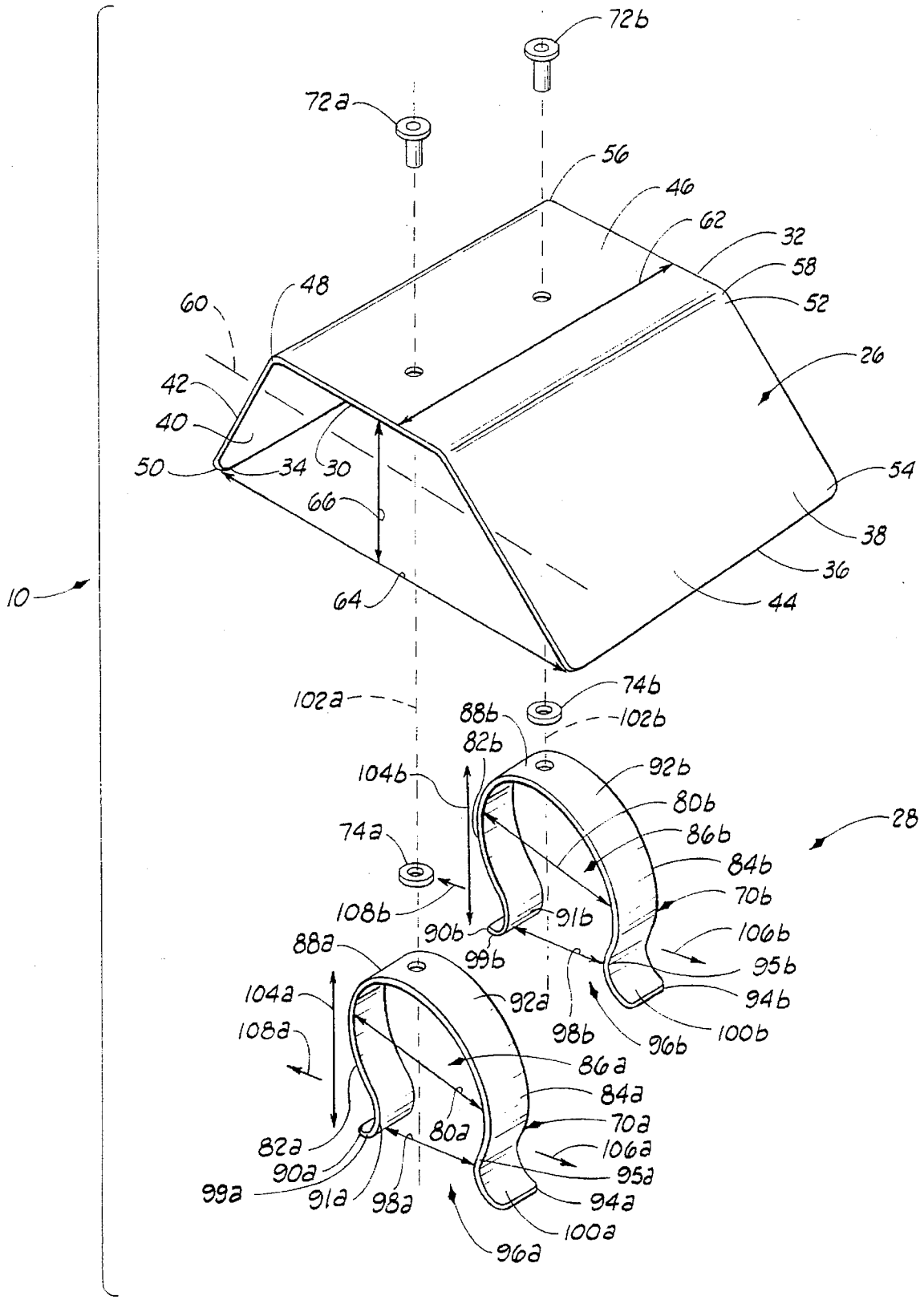
FIG. 2 is an exploded perspective view of the heat shield apparatus of FIG. 1.

Referring now also to FIG. 2, the heat shield apparatus 10 is provided with a heat shield 26 (FIGS. 1, 2 and 5) and a clipping assembly 28 (FIG. 2) for clipping the heat shield 26 to the solenoid 12. The heat shield 26 of the heat shield apparatus 10 has a first end 30 (FIGS. 1 and 2), a second end 32 (FIGS. 1 and 2), a first side 34 (FIGS. 1 and 2), a second side 36 (FIGS. 1 and 2), an upper surface 38 (FIGS. 1 and 2), a lower surface 40 (FIGS. 1 and 2), a planar first side portion 42 (FIGS. 1 and 2), a planar second side portion 44 (FIGS. 1 and 2) and a planar medial portion 46 (FIGS. 1 and 2).

The first side portion 42 of the heat shield 26 has a first end 48 (FIGS. 1 and 2) and a second end 50 (FIGS. 1 and 2). The second side portion 44 of the heat shield 26 has a first end 52 (FIGS. 1 and 2) and a second end 54 (FIGS. 1 and 2). The medial portion 46 of the heat shield 26 has a first end 56 (FIGS. 1 and 2) and a second end 58 (FIGS. 1 and 2). The first end 48 of the first side portion 42 of the heat shield 26 is connected to the first end 56 of the medial portion 46 of the heat shield 26. The first end 52 of the second side portion 44 of the heat shield 26 is connected to the second end 58 of the medial portion 46 of the heat shield 26. The first side portion 42 and the second side portion 44 extend downwardly from the medial portion 46 typically at an angle of about 65° relative to a horizontal centerline 60 (FIG. 2) for forming the heat shield 26 into a substantially U-shape configuration so that the heat shield 26 substantially covers the solenoid coil 20 of the solenoid 12 when the heat shield 26 is clipped thereto for shielding the solenoid coil 20 from heat generated by the engine.

Although the heat shield 26 is shown in FIGS. 1 and 2 as having a substantially U-shaped configuration, it is to be understood that the heat shield 26 may assume any geometric, non-geometric or asymmetrical configuration. For example, the heat shield 26 may assume a triangular or semi-circular configuration.

The heat shield 26 is preferably of unitary construction and formed from a sheet of material capable of reflecting and/or dissipating heat, such as a sheet of tin, aluminum or galvanized steel. Typically, the heat shield 26 is formed from 26 gauge galvanized steel sheet metal. However, it will be appreciated by those skilled in the art that the heat shield 26 can be fabricated of any material capable of serving as a heat shield, such as a ceramic material. In addition, the heat shield 26 can be constructed from two or more sheets of the same or different types of materials stacked one on top of the other.

The heat shield 26 is further provided with a length 62 (FIG. 2), a width 64 (FIG. 2) and a height 66 (FIG. 2). The length 62 of the heat shield 26 extends generally between the first end 30 and the second end 32 of the heat shield 26 and is typically about 83.50 mm. The width 64 of the heat shield 26 extends generally between the first side 34 and the second side 36 of the heat shield 26 and is typically about 105 mm. The height 66 of the heat shield 26 extends generally between the parallel planes in which the second end 50 of the first side portion 42 and the medial portion 46 are disposed. The height 66 of the heat shield 26 is typically about 59 mm.

The clipping assembly 28 will now be described. The clipping assembly 28 includes at least one clip, a first clip and a second clip being shown in FIG. 2 and designated by the reference numerals 70*a* and 70*b*, respectively. Because the first clip 70*a* and the second clip 70*b* are identical in construction and operation, for purposes of clarity only the first clip 70*a* will be described herein. However, like parts on the first and second clips 70*a* and 70*b*, respectively, will be designated in the drawings with the same numeral but different alphabetic suffixes a and b, respectively.

Figure 5:
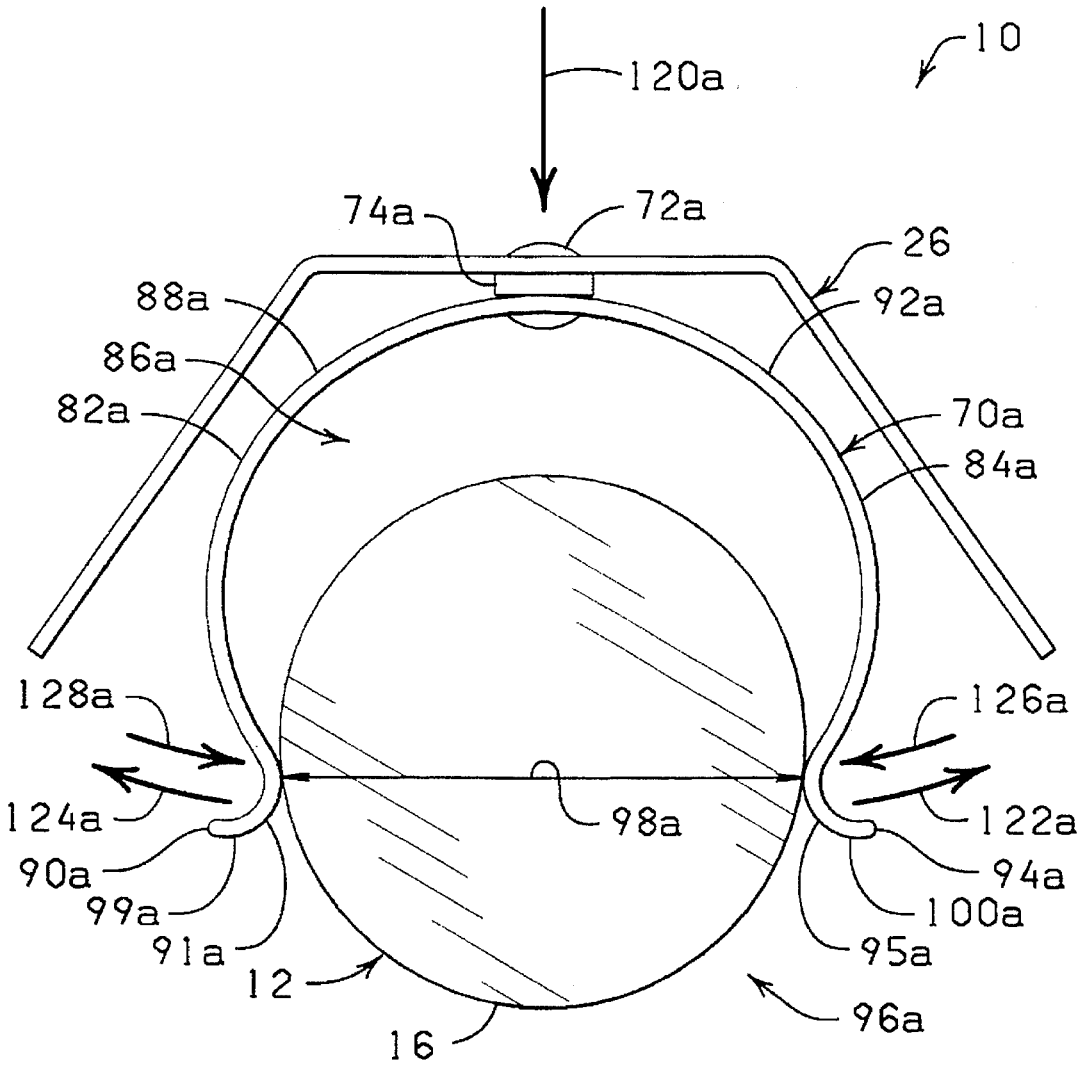
FIG. 5 is a front elevational view of the heat shield apparatus of FIG. 1 illustrating a clipping assembly positioned in a solenoid receiving position.

To provide support to the heat shield 26, the first clip 70*a* is secured to the heat shield 26 in any suitable manner, such as by riveting the first clip 70*a* to the heat shield 26 with a rivet 72*a* (FIGS. 2 and 5). While only one rivet is shown connecting the first clip 70*a* to the heat shield 26, it should be understood that any number of rivets can be used to secure the first clip 70*a* to the heat shield 26 and preferably at least two rivets are used to secure the first clip 70*a* to the heat shield 26. An insulator 74*a* (FIGS. 2 and 5) is interposed between the first clip 70*a* and the heat shield 26 to reduce the amount of heat that is transmitted from the heat shield 26 to the first clip 70*a*. The insulator 74*a* is fabricated of a non-heat conductive material, such as phenolic.

The first clip 70*a* of the heat shield apparatus 10 is disposed near the first end 30 of the heat shield 26 and the second clip 70*b* of the heat shield apparatus 10 is disposed near the second end 32 of the heat shield 26. Typically, the first clip 70*a* is disposed about 7.5 mm from the first end 30 of the heat shield 26 and the second clip 70*b* is disposed about 22 mm from the second end 32 of the heat shield 26.

The first clip 70*a* serves to clippingly and detachably connect the heat shield 26 to the sidewall 16 of the solenoid 12 so that the heat shield apparatus 10 is frictionally maintained thereon. It should be noted that the first clip 70*a* also serves to space the heat shield 26 a predetermined distance from the sidewall 16 of the solenoid 12 so that air freely circulates about the heat shield 26 and dissipates heat therefrom.

The first clip 70*a* is constructed to be force fitted against the sidewall 16 of the solenoid 12 and shaped to conform to the sidewall 16 while permitting the first clip 70*a* to be slidably rotated about the sidewall 16 for positioning the heat shield 26 between the solenoid coil 20 of the solenoid 12 and the engine as indicated by arrows 76 and 78 in FIG. 1 when the first clip 70*a* is disposed on the solenoid 12. It should be noted that the capability of the first clip 70*a* to be rotated about the solenoid 12 allows the heat shield apparatus 10 to be used with starters which are mounted on either the right or left hand side of the engine, for example.

The first clip 70*a* has a diameter 80*a* (FIG. 2) slightly less than the diameter 22 of the sidewall 16 of the solenoid 12 so that when the first clip 70*a* is clipped onto the solenoid 12, the first clip 70*a* fits snugly against the solenoid 12. Typically, the diameter 80*a* of the first clip 70*a* is about 56 mm.

The first clip 70*a* has an arc-shaped first arm 82*a* (FIGS. 2 and 5) and an arc shaped second arm 84*a* (FIGS. 2 and 5) cooperating to define a solenoid receiving slot 86*a* (FIGS. 2 and 5) configured to accommodate the sidewall 16 of the solenoid 12. The first arm 82*a* has a first end 88*a* (FIGS. 2 and 5), a second end 90*a* (FIGS. 2 and 5), and a shoulder portion 91*a* (FIGS. 2 and 5) disposed near the second end 90*a* thereof. The second arm 84*a* has a first end 92*a* (FIGS. 2 and 5), a second end 94*a* (FIGS. 2 and 5), and a shoulder portion 95*a* (FIGS. 2 and 5) disposed near the second end 94*a* thereof. The first end 88*a* of the first arm 82*a* is connected to the first end 92*a* of the second arm 84*a*. The second end 90*a* of the first arm 82*a* is spaced a distance from the second end 94*a* of the second arm 84*a* such that the shoulder portion 91*a* is spaced a distance from the shoulder portion 95*a* for providing the first clip 70*a* with a solenoid receiving passageway 96*a* (FIGS. 2 and 5) in open communication with the solenoid receiving slot 86*a*. The solenoid receiving passageway 96*a* has a width 98*a* (FIGS. 2 and 5) extending between the shoulder portions 91*a* and 95*a* typically of 20.4 mm when the solenoid 12 is not disposed in the solenoid receiving slot 86*a*.

To facilitate the insertion and removal of the solenoid 12 from the solenoid receiving slot 86*a* via the solenoid receiving passageway 96*a*, the first arm 82*a* is provided with a curved lip 99*a* (FIGS. 2 and 5) extending outwardly from the shoulder portion 91*a* and the second arm 84*a* is provided with a curved lip 100*a* (FIGS. 2 and 5) extending outwardly from the shoulder portion 95*a*. It should be noted that the curved lips 99*a* and 100*a* of the first and second arms 82*a* and 84*a*, respectively, extend outwardly at an angle of about 45° relative to a vertical centerline indicated by a dashed line 102*a* (FIG. 2).

The second ends 90*a* and 94*a* of the first and second arms 82*a* and 84*a*, respectively, of the first clip 70*a* are disposed a distance 104*a* (FIG. 2) from the first ends 88*a* and 92*a* of the first and second arms 82*a* and 84*a*, respectively. The distance 104*a* is greater than the radius 24 of the solenoid 12 so that when the first clip 70*a* is disposed on the solenoid 12, the second end 90*a* of the first arm 82*a* and the second end 94*a* of the second arm 84*a* extend about at least a portion of the side of the solenoid 12 disposed opposite from the heat shield 26 thereby permitting the second ends 90*a* and 94*a* to frictionally grip the sidewall 16 of the solenoid 12 and resist the removal of the heat shield apparatus 10 therefrom. The distance 104*a* is typically about 62 mm.

The first clip 70*a* is constructed of a material having an elastic quality for permitting the first and second arms 82*a* and 84*a* to be selectively movable between a solenoid clamping position and a solenoid receiving position. When the first arm 82*a* and the second arm 84*a* of the first clip 70*a* are positioned in the solenoid clamping position (FIGS. 3 and 4), the width 98*a* of the solenoid receiving slot 96*a* is less than the diameter 22 of the sidewall 16 of the solenoid 12 such that the first and second arms 82*a* and 84*a* of the first clip 70*a* are snugly biased against the sidewall 16 of the solenoid 12 when the first clip 70*a* is disposed on the solenoid 12. When the first arm 82*a* and the second arm 84*a* of the first clip 70*a* are positioned in the solenoid receiving position (shown in FIG. 5), the second end 90*a* of the first arm 82*a* is moved away from the second end 94*a* of the second arm 84*a* (as indicated by the arrows 106*a* and 108*a* of FIG. 2) until the width 98*a* of the solenoid receiving passageway 96*a* is greater than the diameter 22 of the sidewall 16 of the solenoid 12 (FIG. 5) for permitting the first clip 70*a* to be inserted onto the solenoid 12.

In the preferred embodiments which are shown in the drawings, the first arm 82*a* and the second arm 84*a* of the first clip 70*a* are integrally constructed. However, it should be understood that the first arm 82*a* and the second arm 84*a* of the first clip 70*a* can be two or more separate members with each member individually securable to the other members or the heat shield 26. The first clip 70*a* is desirably formed from a strip of material having elastic and heat resilient qualities, such as a strip of blued spring steel having a thickness of 1.10 mm.

Referring to FIG. 5, the installation of the heat shield apparatus 10 on the solenoid 12 of the starter 14 will be discussed. To install the heat shield apparatus 10 on the solenoid 12 of the starter 14, the heat shield apparatus 10 is clipped onto the solenoid 12 by disposing the curved lip 99*a* of the first arm 82*a* and the curved lip 100*a* of the second arm 84*a* against the sidewall 16 of the solenoid 12. Then, force is applied to the heat shield 26 in a direction 120*a* (FIG. 5) so as to bias the first clip 70*a* against the solenoid 12 and force the curved lips 99*a* and 100*a* in the directions indicated by arrows 122*a* (FIG. 5) and 124*a* (FIG. 5) against the elastic quality of the first clip 70*a* and into the solenoid receiving position for allowing the solenoid 12 to slide into the solenoid receiving slot 86*a*. The elastic quality of the first clip 70*a* then biases the outwardly curved lips 99*a* and 100*a* in an opposite direction (as indicated by arrows 126*a* (FIG. 5) and 128*a* (FIG. 5)) so that the first arm 82*a* and the second arm 84*a* of the first clip 70*a* are moved into the solenoid clamping position for gripping the solenoid and for clippingly and detachably connecting the first clip 70*a* onto the solenoid. In this position, the first arm 82*a* and the second arm 84*a* of the first clip 70*a* substantially conform to the shape of the sidewall 16 of the solenoid 12 of the starter 14 and are biased snugly against the sidewall 16 by the elastic quality of the first clip 70*a* for frictionally maintaining the heat shield apparatus 10 in a selected position. The heat shield apparatus 10 is then slidably rotated about the solenoid 12 and frictionally maintained thereon in a selected position by the first clip 70*a* so that the heat shield 26 is positioned between the solenoid 12 and the engine thereby shielding the solenoid coil 20 of the solenoid 12 from heat generated by the engine.

Figure 3:
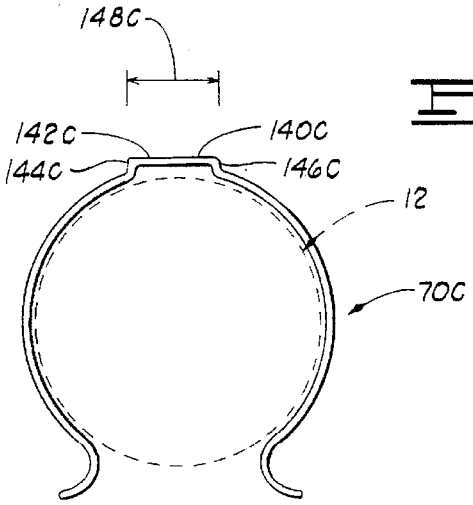
FIG. 3 is a front elevational view of a modified clip which may be used with the heat shield shown in FIG. 2.

Embodiment of FIG. 3

FIG. 3 illustrates another embodiment of a clip 70*c* constructed in accordance with the present invention to be used in combination with the heat shield 26. The clip 70*c* is constructed and operates identically to the first clip 70*a* which was hereinbefore described with reference to FIGS. 1, 2 and 5, except that the clip 70*c* has a raised portion 140*c* (FIG. 3). The raised portion 140*c* serves to space the heat shield 26 of the heat shield apparatus 10 a predetermined distance from the solenoid 12 when the heat shield apparatus 10 is disposed thereon so that air may freely circulate between the heat shield 26 and the solenoid 12. The raised portion 140*c* of the clip 70*c* is also provided with a flat surface 142*c* (FIG. 3) adapted to fit flat against the heat shield 26 and provide the heat shield apparatus 10 with a more stable structure.

The flat surface 142*c* has a first end 144*c* (FIG. 3), a second end 146*c* (FIG. 3) and a width 148*c* (FIG. 3) extending therebetween. The width 148*c* is typically about 20 mm.

Figure 4:
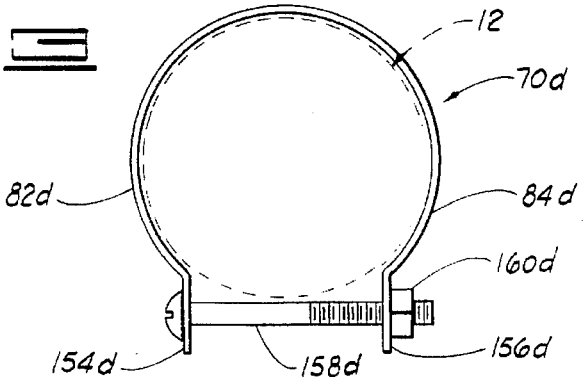
FIG. 4 is a front elevational view of another modified clip which may be used with the heat shield shown in FIG. 2.

Embodiment of FIG. 4

FIG. 4 illustrates another embodiment of a clip 70*d* constructed in accordance with the present invention to be used in combination with the heat shield 26. The clip 70*d* is constructed and operates identically to the first clip 70*a* which was hereinbefore described with reference to FIGS. 1, 2 and 5, except that a first arm 82*d* (FIG. 4) is provided with a substantially planar flange portion 154*d* (FIG. 4) and a second arm 84*d* of the clip 70*d* is provided with a substantially planar flange portion 156*d* (FIG. 4). Each of the flange portions 154*d* and 156*d* are provided with an aperture (not shown) formed therethrough configured to accommodate a connecting member 158*d* (FIG. 4), such as a bolt for providing the clip 70*d* with a tighter clamping about the sidewall 16 of the solenoid 12 when the clip 70*d* is in the solenoid clamping position. The connecting member 158*d* is disposed through the apertures once the clip 70*d* has been disposed on the solenoid 12 and is maintained thereon via a nut 160*d* (FIG. 4), for example.

The heat shield apparatus 10 of the present invention was tested by clipping the heat shield apparatus 10 to the solenoids of the starters of various makes and models of automobiles. It was found in the study that the heat shield apparatus 10 fit on every General Motors product tested with the exception of the 1984 Oldsmobile Toronado. The heat shield apparatus 10 would not work with the 1984 Oldsmobile Toronado because there was not enough clearance between the solenoid and the engine for the heat shield apparatus 10 to be slidably rotated therebetween once the heat shield apparatus 10 was clippingly and detachably connected to the sidewall of the solenoid.

From the above description it is clear that the present invention is well adapted to carry out the objects and to attain the advantages mentioned herein as well as those inherent in the invention. While a presently preferred embodiment of the invention has been described for purposes of this disclosure, it will be understood that numerous changes may be made which will readily suggest themselves to those skilled in the art. The exact dimensions and proportions of the elements described herein are not essential to the practice of the present invention, but are intended to illustrate the general nature of the embodiments of the present invention. Thus, changes may be made in the embodiments of the invention described herein, or in the parts or the elements of the embodiments described herein, or in the steps or sequence of steps of the methods described herein, without departing from the spirit and/or the scope of the invention as defined in the following claims.

What is claimed is:

1. A heat shield apparatus for shielding a solenoid of a starter from heat generated by an engine, the apparatus comprising:

a heat shield positionable between the engine and the solenoid; and a cllipping assembly connected to the heat shield, the clipping assembly having portions which are selectively movable between a solenoid receiving position for receiving the solenoid of the starter therebetween such that the heat shield is spaced a predetermined distance from the solenoid, and a solenoid clamping position for resiliently gripping the solenoid once the clipping assembly is disposed on the solenoid, the portions of the clipping assembly being slidably rotatable about the solenoid for rotatably positioning the heat shield in a predetermined position between the solenoid and the engine after the clipping assembly has been disposed on the solenoid.

2. The apparatus of claim 1 wherein the clipping assembly further comprises:

a clip having a first arm and a second arm, the first arm being spaced a distance from the second arm to define a solenoid receiving slot configured to accommodate the solenoid, the first arm and the second arm being movable in a direction away from each other to the solenoid receiving position, and the first arm and the second arm being movable in a direction toward each other to the solenoid clamping position.

3. The apparatus of claim 1 wherein the heat shield further comprises a first end and a second end and wherein the clipping assembly further comprises:

two clips with each clip having a first arm and a second arm, the first arm being spaced a distance from the second arm to define a solenoid receiving slot configured to accommodate the solenoid, the first arm and the second arm being movable in a direction away from each other to the solenoid receiving position, and the first arm and the second arm being movable in a direction toward each other to the solenoid clamping position, one of the clips being positioned near the first end of the heat shield and the other clip being positioned near the second end of the heat shield.

4. The apparatus of claim 2 wherein the first arm of the clip has a first end and a second end and the second arm of the clip has a first end and a second end, the first end of the first arm being connected to the first end of the second arm, and the second end of the first arm being spaced a distance from the second end of the second arm for providing the clip with a solenoid receiving passageway in open communication with the solenoid receiving slot.

5. The apparatus of claim 4 wherein the first arm of the clip is provided with a curved lip disposed adjacent the solenoid receiving passageway and extending outwardly therefrom, and the second arm of the clip is provided with a curved lip disposed adjacent the solenoid receiving passageway and extending outwardly therefrom, the curved lip of the first arm and the curved lip of the second arm facilitating the insertion and removal of the solenoid from the solenoid receiving slot.

6. The apparatus of claim 2 wherein the first arm and the second arm of the clip are each provided with an aperture formed therethrough and wherein the apparatus further comprises:

a connecting member disposed through each of the apertures formed in the flange portions of the first and second arms of the clip for more tightly clamping the clip against the solenoid after the clipping assembly has been disposed on the solenoid.

7. The apparatus of claim 2 wherein the clip further comprises a raised portion engageable with the heat shield for spacing the heat shield a predetermined distance from the solenoid when the clipping assembly is disposed on the solenoid whereby air may freely circulate between the heat shield and the solenoid.

8. The apparatus of claim 7 wherein the raised portion of the clip further comprises a surface adapted to fit flat against the heat shield.

9. A method for shielding a solenoid of a starter from heat generated by an engine, the method comprising the steps of:

providing a heat shield apparatus comprising a clipping assembly connected to a heat shield, the clipping assembly having portions which are selectively movable between a solenoid receiving position for receiving the solenoid of the starter therebetween such that the heat shield is spaced a predetermined distance from the solenoid, and a solenoid clamping position for resiliently gripping the solenoid once the clipping assembly is disposed on the solenoid;

moving the portions of the clipping assembly against the solenoid for biasing the clipping assembly into the solenoid receiving position as the clipping assembly is inserted onto the solenoid, the clipping assembly then being biased into the solenoid clamping position for resiliently gripping the solenoid and for clippingly and detachably connecting the clipping assembly onto the solenoid; and rotating the heat shield apparatus about the solenoid in the solenoid clamping position of the clipping assembly such that the heat shield is positioned between the solenoid and the engine.

10. The method of claim 9 wherein the clipping assembly further comprises a pair of apertures dimensioned to receive a connecting member and wherein the method further comprises the step of:

disposing the connecting member through the apertures in the clipping assembly after the clipping assembly has been clippingly and detachably connected to the solenoid; and maintaining the connecting member in the apertures such that the clipping assembly is clamped about the solenoid.

11. The method of claim 9 wherein the step of providing a heat shield apparatus further comprises the step of:

providing the clipping assembly of the heat shield apparatus with a clip having a first arm and a second arm spaced a distance apart to define a solenoid receiving slot configured to accommodate the solenoid, the first arm and the second arm being movable in a direction away from each other to the solenoid receiving position, and the first arm and the second arm being movable in another direction towards each other to the solenoid clamping position.

12. A heat shield apparatus for shielding a solenoid of a starter from heat generated by an engine, the apparatus comprising:

a heat shield positionable between the engine and the solenoid; and a clipping assembly connected to the heat shield, the clipping assembly comprising:

a clip having a first arm and a second arm spaced a distance apart to define a solenoid receiving slot configured to accommodate the solenoid, the first arm and the second arm being selectively movable relative to one another between a solenoid receiving position for receiving the solenoid in the solenoid receiving slot such that the heat shield is spaced a predetermined distance from the solenoid, and a solenoid clamping position for resiliently gripping the solenoid once the solenoid is disposed in the solenoid receiving slot, the first arm and the second arm being slidably rotatable about the solenoid for rotatably positioning the heat shield in a predetermined position between the solenoid and the engine after the solenoid has been disposed in the solenoid receiving slot.

13. The apparatus of claim 12 wherein the heat shield further comprises a first end and a second end and wherein the clipping assembly comprises two clips, one of the clips being positioned near the first end of the heat shield and the other clip being positioned near the second end of the heat shield.

14. The apparatus of claim 12 wherein the first arm of the clip has a first end and a second end and the second arm of the clip has a first end and a second end, the first end of the first arm being connected to the first end of the second arm, and the second end of the first arm being spaced a distance from the second end of the second arm for providing the clip with a solenoid receiving passageway in open communication with the solenoid receiving slot.

15. The apparatus of claim 14 wherein the first arm of the clip is provided with a curved lip disposed substantially adjacent the solenoid receiving passageway and extending outwardly therefrom and the second arm of the clip is provided with a curved lip disposed substantially adjacent the solenoid receiving passageway and extending outwardly therefrom, the curved lip of the first arm and the curved lip of the second arm facilitating the insertion and removal of the solenoid from the solenoid receiving slot.

16. The apparatus of claim 12 wherein the first arm and the second arm of the clip are each provided with an aperture formed therethrough and wherein the apparatus further comprises:

a connecting member disposed through each of the apertures of the first and second arms of the clip when the clip is in the solenoid clamping position for more tightly clamping the clip against the solenoid.

17. The apparatus of claim 14 wherein the clip further comprises a raised portion engageable with the heat shield for spacing the heat shield a predetermined distance from the solenoid when the clip has been disposed on the solenoid so that air may freely circulate between the heat shield and the solenoid.

18. The apparatus of claim 17 wherein the raised portion of the clip further comprises a surface adapted to fit flat against the heat shield.

19. A method for shielding a solenoid of a starter from heat generated by an engine, the solenoid having a diameter and a radius, the method comprising the steps of:

providing a heat shield apparatus comprising a clipping assembly connected to a heat shield, the clipping assembly comprising a clip fabricated of an elastic material, the clip having a first arm and a second arm spaced a distance apart to define a solenoid receiving slot configured to accommodate the solenoid, the first arm having a first end and a second end and the second arm having a first end and a second end, the second end of the first arm being spaced a distance from the second end of the second arm so as to define a solenoid receiving passageway having a width, the second end of the first arm being disposed a distance from the first end of the first arm with the distance between the first end and the second end of the first arm being greater than the radius of the solenoid, the clip having a solenoid clamping position wherein the first arm and the second arm of the clip are biased in one direction into engagement with the solenoid by the elastic quality of the clip for resiliently gripping the solenoid such that the width of the solenoid receiving passageway is less than the diameter of the solenoid, and the clip having a solenoid receiving position wherein the first arm and the second arm of the clip are biased in an opposite direction against the elastic quality of the clip into a position wherein the width of the solenoid receiving passageway is greater than the diameter of the solenoid such that the clip is insertable onto the solenoid;

moving the second end of the first arm and the second end of the second arm against the solenoid so as to bias the clip into the solenoid receiving position against the elastic quality of the clip as the clip is inserted onto the solenoid, the clip then being biased into the solenoid clamping position by the elastic quality of the clip for resiliently gripping the solenoid; and rotating the heat shield apparatus about the solenoid such that the heat shield is positioned between the solenoid and the engine whereby the heat shield apparatus shields the solenoid from heat generated by the engine.

* * * * *

UNITED STATES PATENT AND TRADEMARK OFFICE

CERTIFICATE OF CORRECTION

PATENT NO. : 5,649,510

DATED : July 22, 1997

INVENTOR(S) : GEORGE LINZE

It is certified that error appears in the above-indentified patent and that said Letters Patent is hereby corrected as shown below:

Column 1, line 60, delete the word "manufacture" and substitute therefore the word --manufacturer--.

Column 2, line 55, delete the word "U-shape" and substitute therefore the word --U-shaped--.

Column 4, line 64, delete the numeral "96a" and substitute therefore the numeral --86--.

Column 6, line 63, delete the word "cllipping" and substitute therefore the word --clipping--.

Signed and Sealed this

Twenty-eighth Day of October, 1997

*Attest:*

Bruce Lehman

BRUCE LEHMAN

*Attesting Officer*

*Commissioner of Patents and Trademarks*